US008708522B2

(12) United States Patent
Wang

(10) Patent No.: US 8,708,522 B2
(45) Date of Patent: Apr. 29, 2014

(54) RECONFIGURABLE LIGHTING FIXTURE

(75) Inventor: Qianxiang Wang, Great Neck, NY (US)

(73) Assignee: Edison Price Lighting, Inc., Long Island City, NY (US)

( * ) Notice: Subject to any disclaimer, the term of this patent is extended or adjusted under 35 U.S.C. 154(b) by 336 days.

(21) Appl. No.: 13/160,212

(22) Filed: Jun. 14, 2011

(65) Prior Publication Data

US 2012/0320577 A1 Dec. 20, 2012

(51) Int. Cl.
*F21V 5/04* (2006.01)

(52) U.S. Cl.
USPC ..... 362/235; 362/362; 362/372

(58) Field of Classification Search
USPC ..... 362/235, 362, 372
See application file for complete search history.

(56) References Cited

U.S. PATENT DOCUMENTS

| | | | | |
|---|---|---|---|---|
| 4,791,539 | A * | 12/1988 | Ewing | 362/659 |
| 5,562,343 | A * | 10/1996 | Chan et al. | 362/365 |
| 2001/0006463 | A1 | 7/2001 | Fischer et al. | |
| 2009/0103331 | A1* | 4/2009 | Pazula et al. | 362/649 |
| 2011/0080750 | A1* | 4/2011 | Jones et al. | 362/430 |

OTHER PUBLICATIONS

Edison Price Lighting: Bulletin Archives, "Threes," Dec. 3, 2010, http://www.epl.com/bulletin.cfm?FBB908156F6AE3B6A2E7E19BAEEBC86CCDB8AD . . . (last visited Jul. 13, 2011).
Redacted Edison Price Lighting: Bulletin Archives, http://www.epl.com/bulletin_archives.cfm. (last visited Jul. 13, 2011).

* cited by examiner

*Primary Examiner* — Joseph L Williams
(74) *Attorney, Agent, or Firm* — Richard J. Katz, Esq.

(57) ABSTRACT

A lighting fixture includes a housing having a surface with a fixture aperture therein, a light source assembly mountable within the housing in a replaceable manner and sized to fit through the aperture, the light source assembly includes electrical contacts configured to be in electrical communication with a light source. The lighting fixture also includes an electric input conditioner mounted within the housing in a replaceable manner and sized to fit through the aperture, the electric input conditioner is in electrical communication with the electrical contacts. The lighting fixture also includes a mount assembly in mechanical communication with the housing and configured to position the light source assembly within the housing at a location for light from the light source to emit through the aperture, wherein the light source assembly and the electric input conditioner accommodate a first light source technology, and are replaceable to accommodate a different technology.

19 Claims, 8 Drawing Sheets

RECONFIGURABLE LIGHTING FIXTURE

BACKGROUND

Lighting fixtures are a common and effective source of light. The light source within the lighting fixture can be selected to match the purpose of the lighting fixture. The light source itself can be drawn from any one of an assortment of light source technologies, e.g., incandescent, high intensity discharge, and/or light emitting diodes (LED). Each of these light source technologies has a different electrical requirement (e.g., starting and operating voltage, current, direct or alternating current, etc.), which the lighting fixture is required to accommodate.

The nature of the lighting task can also be a determining factor in the type of light source. Additionally, the light source's mounting configuration within a lighting fixture also can determine the lighting application to which a particular fixture can be applied. A downlight lighting fixture can concentrate light in a downward direction. A downlight may include a spotlight to produce a narrow beam of intense light, or a floodlight to be used for general lighting tasks. A wallwasher lighting fixture is popular for lighting wall surfaces, with a broad beam of light. The wallwasher lighting fixture is commonly used in a variety of architectural spaces. The wallwasher lighting fixture can produce evenly illuminated walls, and can create a sense of lighter, brighter, bigger, and higher spaces. An accent lighting fixture can brighten dark corners, or highlight art and architectural features, so its placement is determined by these features.

Conventional lighting fixtures are typically mounted in place, and are of a predetermined configuration—e.g., the light source's technology and the fixture's lighting application are determined prior to installation of the lighting fixture. Should a change to the lighting application be desired by a lighting designer, decorator, architect, etc., removal of the entire conventional lighting fixture and replacement by another lighting fixture meeting the new lighting application requirements is necessary. This removal and replacement results in an increased cost in the repair to the actual mounting surface, and a waste of the original (and oftentimes still functioning) lighting fixture.

DETAILED DESCRIPTION

A lighting fixture in accordance with an embodiment of the invention is reconfigurable without needing to remove the lighting fixture after it is mounted. The light source technology used in the lighting fixture can be changed, and/or the lighting application for which the lighting fixture is used can also be changed. A light source assembly within the fixture can be removed through a fixture aperture in the lighting fixture's housing and replaced through the fixture aperture while the lighting fixture itself remains in its installed location. This fixture aperture can be located opposing a light source in the light source assembly.

An electric input conditioner and a mount assembly can also be removed and replaced through the fixture aperture as well. The electric input conditioner can be replaced to correspond to the requirements of the light source technology being used in the lighting fixture (e.g., incandescent, LED, high intensity discharge lamp, etc.). The mount assembly is used to position the light source assembly in proximity to the optical aperture to accommodate the lighting application (e.g., downlight, wallwasher, adjustable accent, etc.). Replacement of the mount assembly through the fixture aperture reconfigures the lighting fixture for a different lighting application without the need to remove the lighting fixture from its mounted location.

Figure 1A:
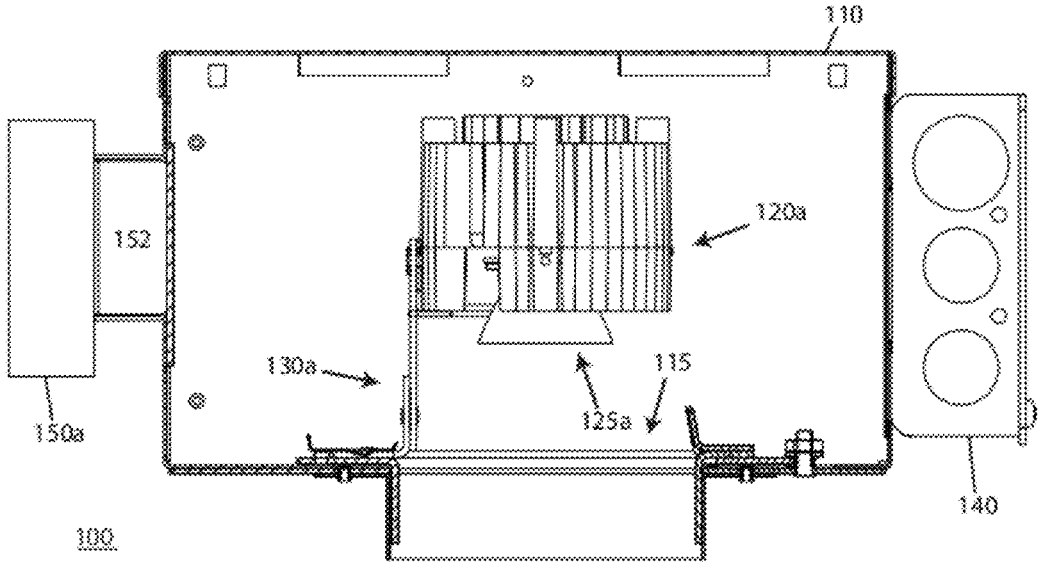
FIGS. 1A-1C illustrate a cross sectional view of a lighting fixture in accordance with an embodiment of the invention.

FIG. 1A is a cross-sectional view of lighting fixture 100 in accordance with an embodiment of the invention. In certain embodiments, e.g., a recessed lighting fixture, one or more rail support brackets can be slideably attached to housing 110. The rail support bracket is used to mount the lighting fixture to a wall stud, ceiling joist, floor joist, or some other structure. The rail support bracket can be attached to the housing via a threaded screw and wing nut. A slot on the rail support bracket allows for movement along one axis. Other slot arrangements can provide movement in other axes.

In other embodiments in accordance with the invention,—for example, free standing, surface mount, floor, or track lighting embodiments, the presence of a rail support bracket might not be needed. Instead, other brackets, mounts, and/or connective structure are used to achieve the stable positioning of the lighting fixture.

With reference to FIG. 1A, lighting fixture 100 includes housing 110 which has a surface with fixture aperture 115 located therein. Fixture aperture 115 can have a minimum diameter of about 3 inches. A fixture aperture having an opening of about this diameter makes a small footprint on the surface to which it is mounted. Light source assembly 120*a* can be positioned within housing 110 by mount assembly 130*a* so that light source 125*a*, mounted on the light source assembly, emits light through fixture aperture 115.

Figure 4:
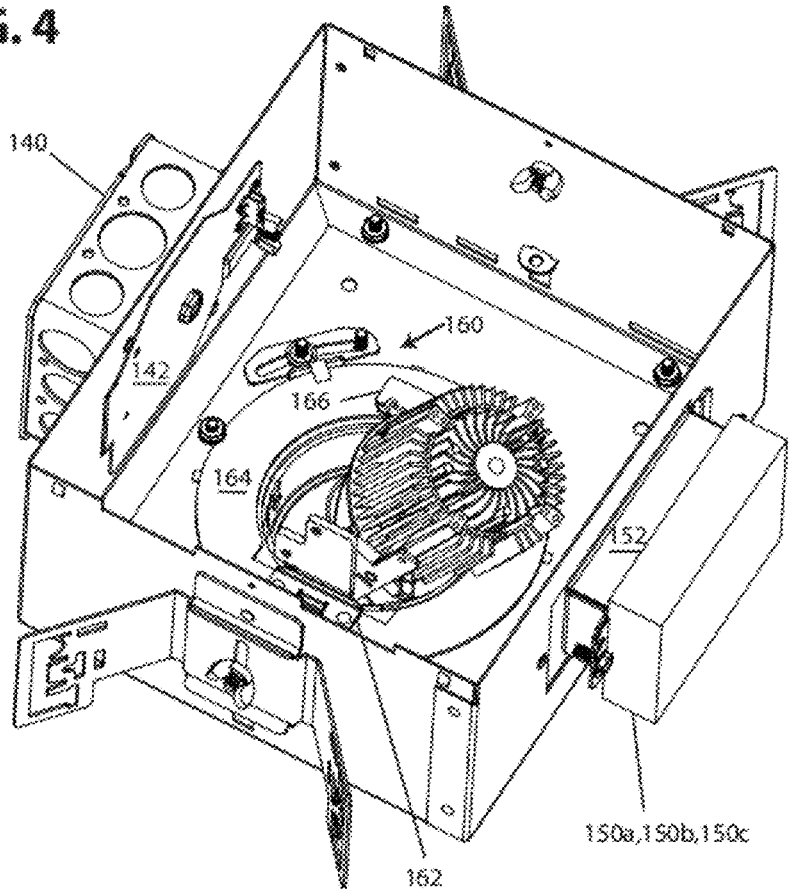
FIG. 4 illustrates a perspective view of an interior portion of the embodiment of FIG. 1B.

FIG. 4 is a perspective view of an internal portion of lighting fixture 100 in accordance with an embodiment of the invention. In accordance with an embodiment of the invention, mounted on a surface of housing 110 can be junction box 140. The junction box provides a safe receptacle for making wiring connections between an external source of electrical power (not shown) and lighting fixture 100. The wiring connections within the junction box can be accessed through the illumination aperture by opening access panel 142.

Figure 2A:
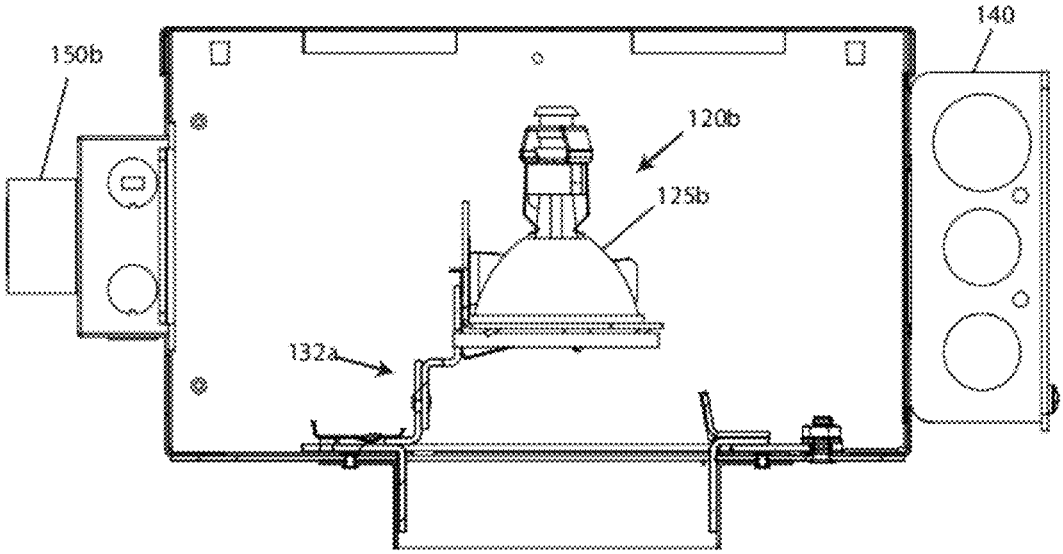
FIGS. 2A-2C illustrate a cross sectional view of a lighting fixture in accordance with an embodiment of the invention.

Lighting fixture 100 may accommodate a variety of light source technologies. For example, light source assembly 120*a* can include a light emitting diode (LED) light source module that includes LED array light source 125*a*. In other implementations, light source assembly 120*b* (FIG. 2A) can include halogen light source 125*b* (FIG. 2A), light source assembly 120*c* (FIG. 3A) can include high intensity discharge (HID) light source 125*c* (FIG. 3A), etc. Light source assembly 120*a*, 120*b*, 120*c* may be sized to be removed through the fixture aperture, and replaced with a light source assembly having a different light source technology. For instance, suppose lighting fixture 100 includes a first light source technology (e.g., LED, halogen, HID, etc.), the first light source assembly may be replaced through the fixture aperture with a light source assembly having a different light source technology. The light source assembly includes electrical contacts to connect the light source to a source of electrical power.

Figure 3A:
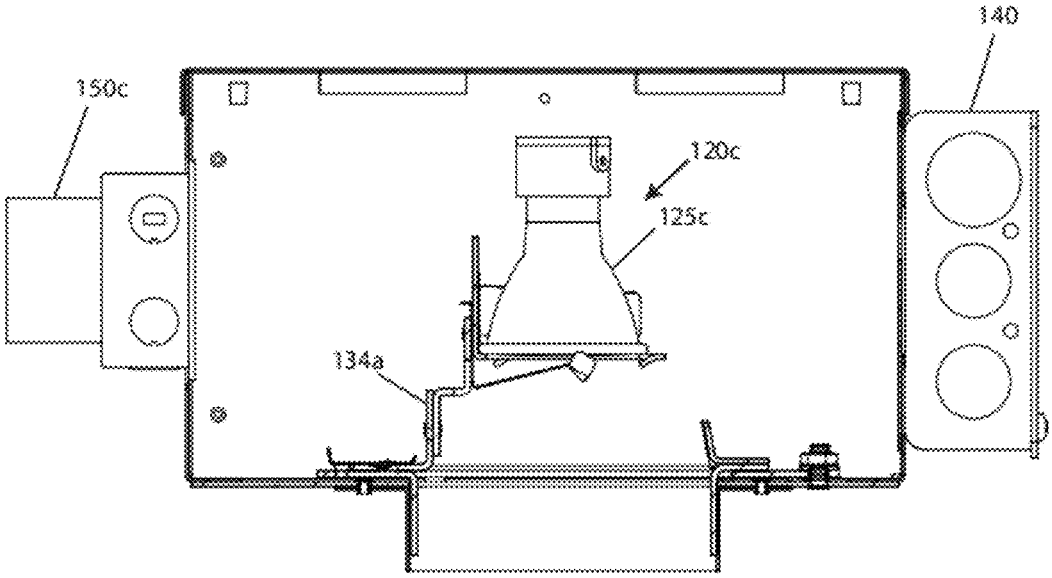
FIGS. 3A-3C illustrate a cross sectional view of a lighting fixture in accordance with an embodiment of the invention.

Each variety of light source technology may require a different electric input conditioner 150*a* (FIG. 1A), 150*b* (FIG. 2A), 150*c* (FIG. 3A). The electric input conditioner acts as an interface between the external source of electrical power and light source assemblies 120*a*, 120*b*, 120*c* so that the electrical input to the light source assembly corresponds to the requirements for the light source technology. For example, light source assembly 120*a* can include an LED array light source, which operates on a direct current (DC) voltage. Accordingly, electric input conditioner 150*a* may be a LED driver which supplies a regulated DC voltage to LED array light source 125*a*. Wiring connected to the LED driver can be fed into the junction box, where the wiring is connected to the external source of power. In one implementation, the external source of power may itself be a DC voltage supply suitable to power the LED array light source.

If lighting fixture 100 includes light source assembly 120*b* having halogen light source 125*b*, electrical input conditioner 150*b* can be a transformer. If the lighting fixture includes light source assembly 120*c* having HID light source 125*c*, electric input conditioner 150*c* can be a ballast to provide the proper starting and operating electrical condition for the HID light source.

Electrical input conditioner 150*a*, 150*b*, 150*c* is sized to be removed through the fixture aperture, and replaced with an electrical input conditioner for a different light source technology. For instance, suppose lighting fixture 100 includes light source assembly 120*a* having an LED array light source and electrical input conditioner 150*a* (an LED driver), if light source assembly 120*b* having a halogen light source is used to replace light source assembly 120*a* then electric input conditioner 150*b* (a transformer) is used as a replacement for electric input conditioner 150*a*. As is readily understood from the preceding example, a first light source technology with a corresponding first electric input conditioner can be replaced via the fixture aperture with a different light source technology and its corresponding different electric input conditioner.

In accordance with an embodiment of the invention, electric input conditioner 150*a*, 150*b*, 150*c* can be mounted to splice box 152 (FIG. 4) that is mounted on a surface of housing 110. Electrical connection to wires for electric input conditioner 150*a*, 150*b*, 150*c* can be accessed through splice box 152 via opening access panel 156 (not shown) located on housing 110 after the electric input conditioner is mounted through the fixture aperture.

Figure 5:
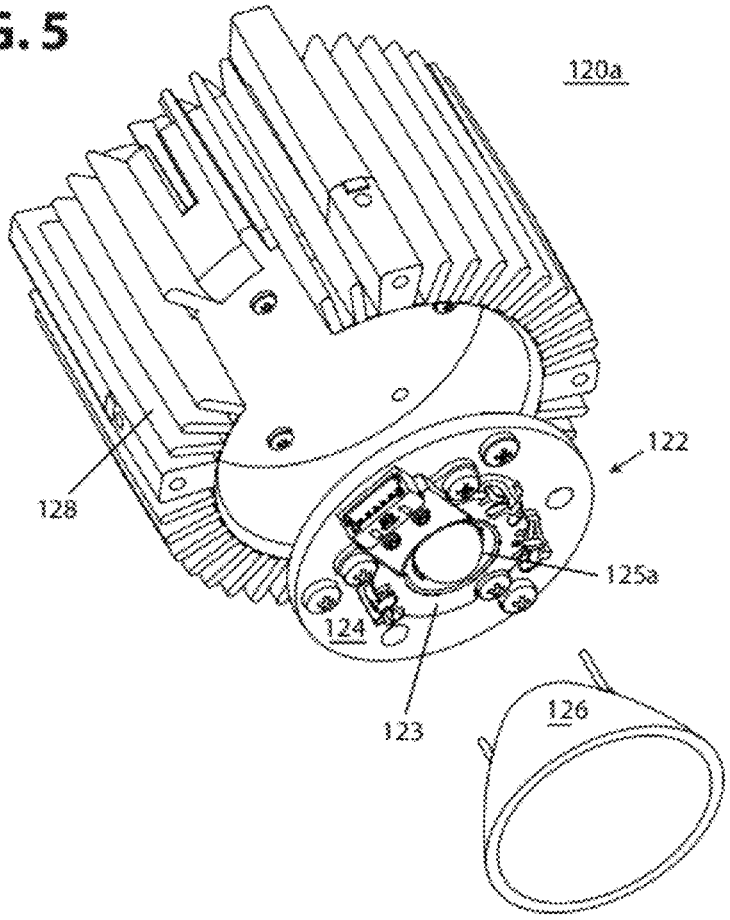
FIG. 5 illustrates an exploded view of a light source assembly in accordance with the embodiment of FIGS. 1A-1C.

FIG. 5 illustrates an exploded view of light source assembly 120*a*. Light source assembly 120*a* is configured for LED light source technology and includes heat sink 128, core module assembly 122, and secondary reflector 126. Core module assembly 122 includes socket 123 in which LED array light source 125*a* can be mounted. Socket 123 positions the LED array light source so that it is in thermal contact with core module base 124, which is a thermal conductive material. Mounting core module assembly 122 in heat sink 128 completes a thermal path between the LED array light source and the heat sink. Socket 123 includes an electrical connector and circuitry to connect the LED array light source to the LED driver output. Secondary reflector 126 is engaged by resilient clamp projections on socket 123 to locate the secondary reflector in proximity to LED array light source 125*a*.

Figure 1B:
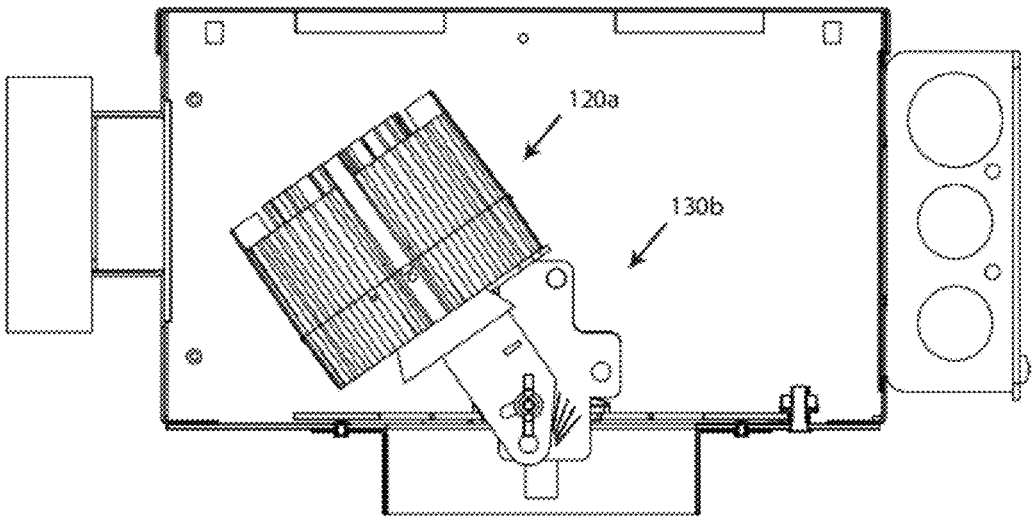
Figure 1C:
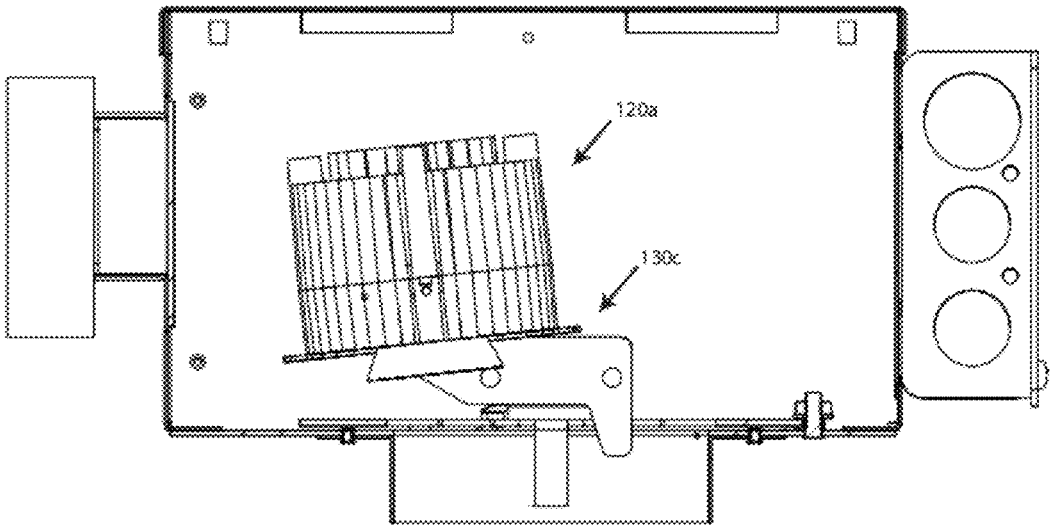
Figure 2B:
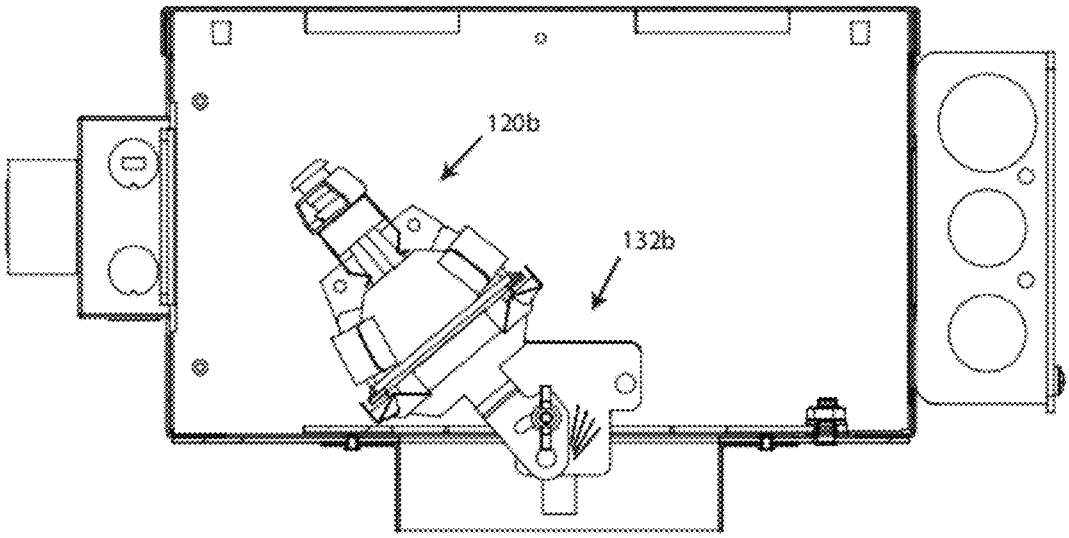
Figure 2C:
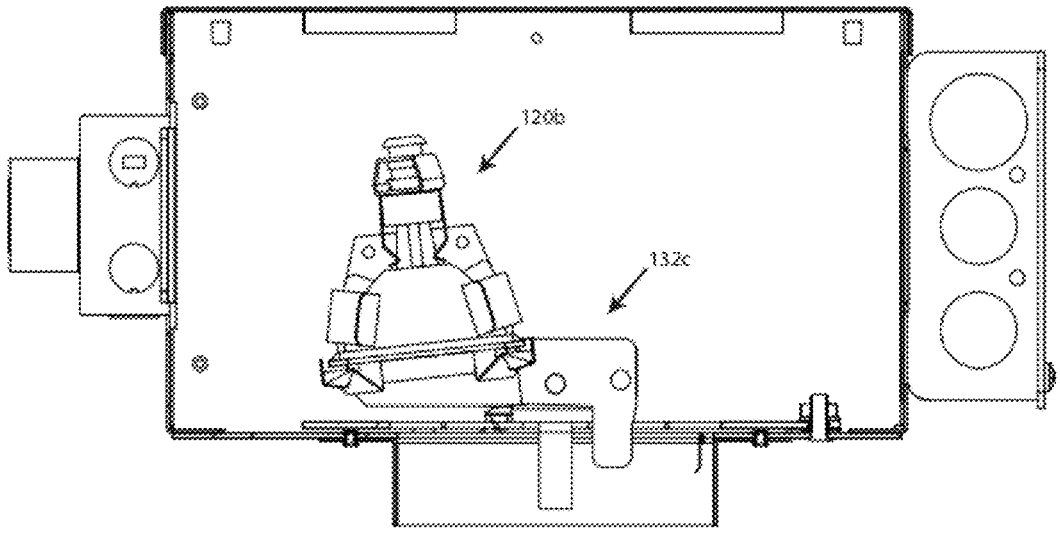
Figure 3B:
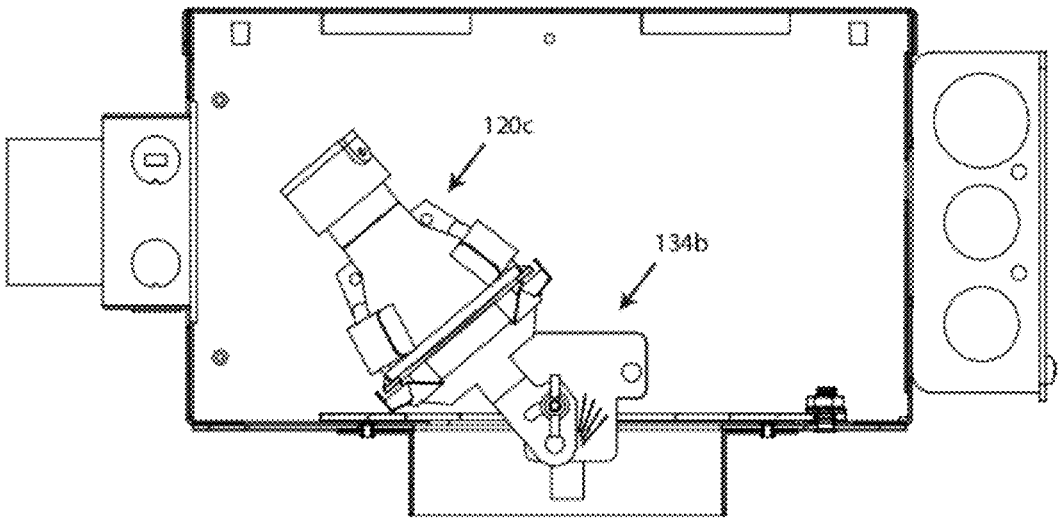
Figure 3C:
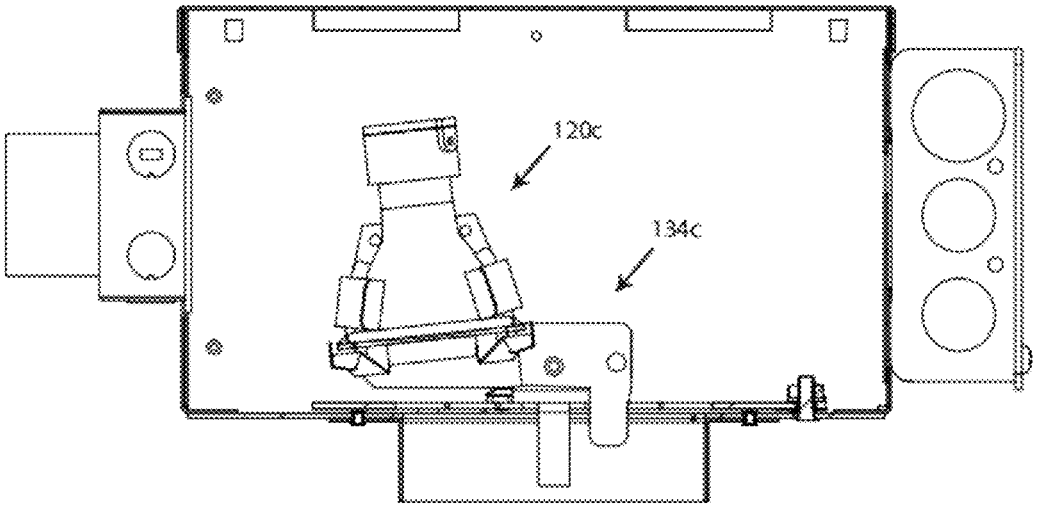

Lighting fixture 100 may be used for a variety of lighting applications (e.g., downlight, adjustable accent, wallwasher, etc.). A mount assembly positions the lighting source assembly in proximity to the fixture aperture so that light from the light source emits through the fixture aperture. The mount assembly is configured to accommodate the lighting application, and is sized to be replaceable through the fixture aperture without the need to remove the lighting fixture from its mounted location. Light source assembly 120*a* is positioned by mount assembly 130*a* (FIG. 1A), 130*b* (FIG. 1B), 130*c* (FIG. 1C) for downlight, adjustable accent, and wallwasher lighting applications, respectively. Light source assembly 120*b* is positioned by mount assembly 132*a* (FIG. 2A), 132*b* (FIG. 2B), 132*c* (FIG. 2C) for downlight, adjustable accent, and wallwasher lighting applications, respectively. Light source assembly 120*c* is positioned by mount assembly 134*a* (FIG. 3A), 134*b* (FIG. 3B), 134*c* (FIG. 3C) for downlight, adjustable accent, and wallwasher lighting applications, respectively.

Figure 6A:
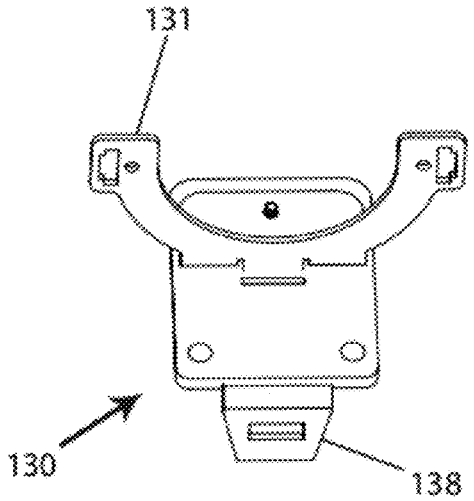
FIGS. 6A-6C illustrate embodiments of mounting assemblies in accordance with the invention.
Figure 6B:
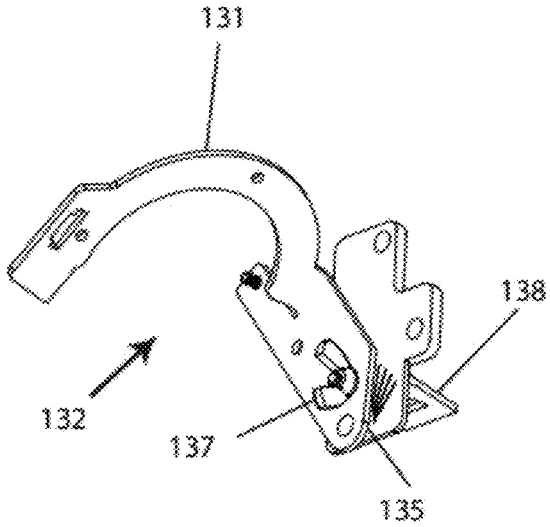
Figure 6C:
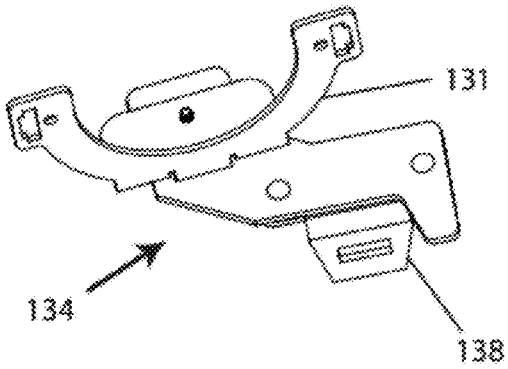

FIGS. 6A-6C illustrate mount assembly 130, 132, 134 in accordance with the invention. The mount assembly can be mounted to fixture housing 110 by mechanical interface to mounting surface 160 (FIG. 4). Mount assembly 130, 132, 134 may be sized to be removed through the fixture aperture, and replaced with a mount assembly for a different lighting application. For instance, suppose lighting fixture 100 includes a first mount assembly to configure the lighting fixture for a first lighting application (e.g., downlight, adjustable accent, wallwasher, etc.), the first mount assembly may be replaced through the fixture aperture with a different mount assembly to configure the lighting fixture for a different lighting application.

In accordance with an embodiment of the invention, mount assembly 132 can position the lighting source assembly so that lighting fixture 100 is configured as an adjustable accent lighting fixture (mount assembly 130 configures the lighting fixture as a downlight, and mount assembly 134 configures the lighting fixture as a wallwasher). Mounting surface 131 depicted in FIGS. 6A-6C is designed for attachment to the LED light source assembly (FIG. 5), Other light source assemblies (e.g., halogen, HID, incandescent, etc.) use different mount surface configurations, which are depicted in FIGS. 2A-2B and 3A-3C.

Mount assembly 130, 132, 134 (FIG. 6) includes tab 138 which can mechanically engage a retention mechanism 162 on a rotation ring 164 in contact with mounting surface 160. Mount assembly 132, 134 can rotate with the rotation ring about a first axis that is normal to the fixture aperture. Rotating the mount assembly about the first axis allows the mounted light source assembly to be positioned at a plurality of directions about the first axis. Rotation locking member 166 can be activated to lock the movement of the rotation ring.

Figure 4A:
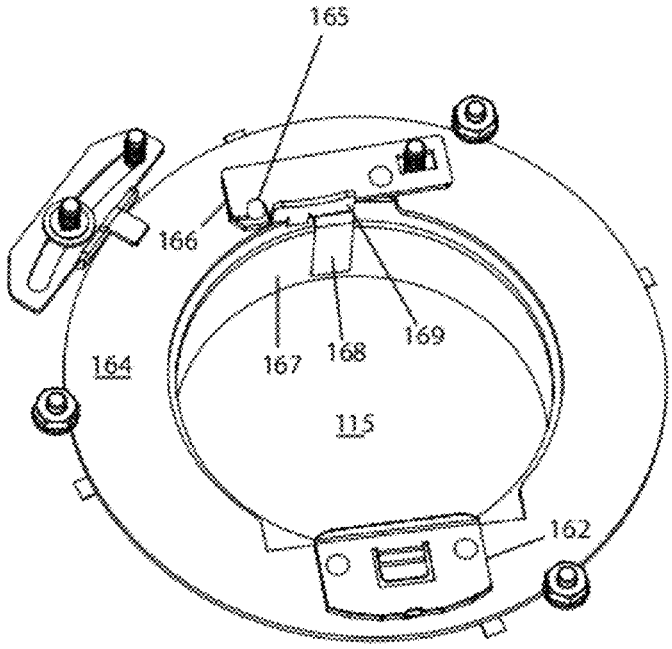
FIG. 4A illustrates a perspective view of a portion of the embodiment illustrated in FIG. 4.

FIG. 4A illustrates a perspective view of a portion an internal portion of lighting fixture 100 depicting detail of rotation locking member 166 in accordance with one embodiment of the invention. In this embodiment, rotation locking member 166 can pivot about a pin (e.g., rod, bolt, rivet, etc.) protruding from the surface of the rotation ring. In operation, rotation locking member 166 can be rotated towards the center of fixture aperture 115 by pulling on tab 168. Due to the exertion of the pulling force, the rotation locking member flexes over the stop engaging notch 165 and releases the force holding locking wedge 168 in place. The locking wedge may be positioned along the circumferential collar 167 of the fixture aperture. One surface of the locking wedge can have a resilient material (e.g., rubber, synthetic polymer, etc.) that is depressed by tab 169 as the rotation locking member is rotated back from the center of the fixture aperture. The rotation locking member rides over the stop, and flexes down so that notch 165 engages the stop, which keeps the rotation locking member in the locked position. The force exerted on wedge 168 by tab 169 is sufficient to lock the rotation ring in place. In another implementation, the rotation locking member can be stationary and include a set screw positioned above the rotation ring or against the circumferential collar 167. Setting the set screw against can exert a locking pressure on the rotation ring.

Further, mount assembly 132 can include tilt adjustment mechanism 135 so that the lighting source assembly can be positioned by tilting it about a second axis which is substantially orthogonal to the first axis. For example, tilting about this second axis may position the lighting source assembly at a plurality of angles with respect to a plane normal to the surface having fixture aperture 115 therein. In one implementation, tilt adjustment mechanism 135 can include locking member 137 to hold the light source assembly in position.

Figure 7A:
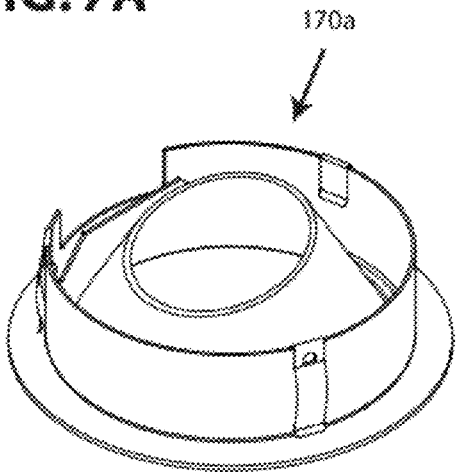
FIGS. 7A-7C illustrate a main reflector in accordance with an embodiment of the invention.
Figure 7B:
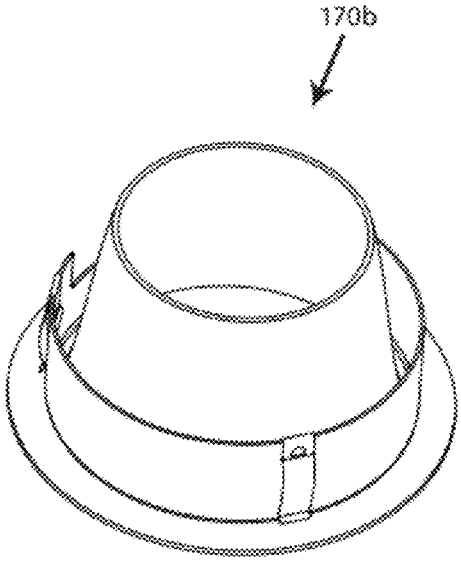
Figure 7C:
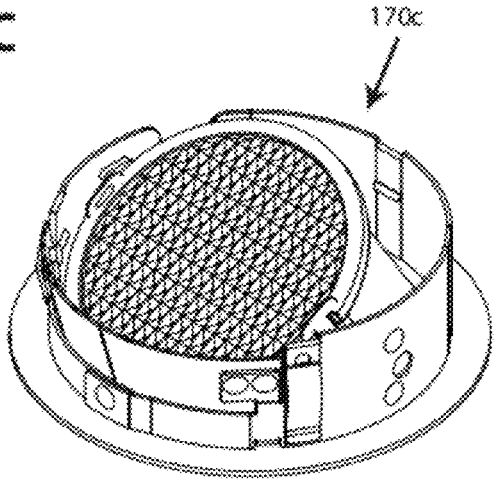

FIGS. 7A-7B illustrate main reflector 170*a*, 170*b*, 170*c* in accordance with an embodiment of the invention. Main reflector 170*a*, 170*b*, 170*c* may be placed over fixture aperture 115 for adjustable accent, downlight, or wallwasher lighting applications, respectively.

While there have been shown and described fundamental novel features of the invention as applied to one or more embodiments, it will be understood that various omissions, substitutions, and changes in the form, detail, and operation of these embodiments may be made by those skilled in the art without departing from the spirit and scope of the invention. Substitutions of elements from one embodiment to another are also fully intended and contemplated. The invention is defined solely with regard to the claims appended hereto, and equivalents of the recitations therein.

I claim:

1. A lighting fixture comprising:

a housing having a surface including fixture aperture therein;

a replaceable light source assembly including a socket configured to accept a first light source of a first light source technology, the light source assembly mountable on a replaceable mount assembly within the housing in a replaceable manner and sized to fit through the fixture aperture, the light source assembly including electrical contacts configured to be in electrical communication with the first light source;

a replaceable electric input conditioner corresponding to the first light source technology and mounted within the housing in a replaceable manner and sized to fit through the fixture aperture, the electric input conditioner in electrical communication with the electrical contacts;

the mount assembly configured to accommodate a first lighting application, and in mechanical communication with the housing and configured to position the light source assembly within the housing at a location for light from the light source to emit through the fixture aperture;

the light source assembly and the electric input conditioner configured to be replaceable to accommodate a light source technology different from the first light source technology;

the mount assembly configured to accommodate a lighting application different from the first lighting application; and the light source assembly, the electric input conditioner, and the mount assembly each configured to be replaced separately.

2. The lighting fixture of claim 1, the first light source technology and the different light source technology being, respectively, one of a halogen light source, a light emitting diode (LED) light source, and a high intensity discharge (HID) light source, wherein the first light source technology and the different light source technology are different light source technologies.

3. The lighting fixture of claim 2, the LED light source including a heat sink and an LED array in thermal communication with the heat sink.

4. The lighting fixture of claim 3, the LED light source including a socket configured to hold the LED array, and a secondary reflector mounted to the socket.

5. The lighting fixture of claim 2, the electrical input conditioner including a transformer in electrical communication with the halogen light source.

6. The lighting fixture of claim 5, the housing including a surface having a splice box mounted thereon, the transformer mounted on the splice box and accessible from within the housing through the fixture aperture.

7. The lighting fixture of claim 2, the electrical input conditioner including a ballast in electrical communication with the HID light source.

8. The lighting fixture of claim 7, the housing including a surface having a splice box mounted thereon, the ballast mounted on the splice box and accessible from within the housing through the fixture aperture.

9. The lighting fixture of claim 2, the electrical input conditioner including a LED driver in electrical communication with the LED light source module.

10. The lighting fixture of claim 9, the housing including a surface having a splice box mounted thereon, the LED driver mounted on the splice box and accessible from within the housing through the fixture aperture.

11. The lighting fixture of claim 1, the mount assembly sized to fit through the fixture aperture.

12. The lighting fixture of claim 1, the first lighting application and the different lighting application being, respectively, one of a downlight lighting application, a wallwasher lighting application, and an accent lighting application.

13. The lighting fixture of claim 12, wherein a mount assembly configured to accommodate the accent lighting application includes a tilt adjustment mechanism configured to position the light source assembly about a second axis.

14. The lighting fixture of claim 13, the tilt adjustment mechanism including a locking member.

15. The lighting fixture of claim 12, wherein a mount assembly configured to accommodate the accent lighting application is configured to mechanically engage a rotation ring operable to rotate the light source assembly about a first axis.

16. The lighting fixture of claim 15, including a rotation locking member contactable with the rotation ring and configured to lock the movement of the rotation ring.

17. The lighting fixture of claim 12, wherein a mount assembly configured to accommodate the wallwasher lighting application is configured to mechanically engage a rotation ring operable to rotate the light source assembly about a first axis.

18. The lighting fixture of claim 17, including a rotation locking member contactable with the rotation ring and configured to lock the movement of the rotation ring.

19. The lighting fixture of claim 12, the lighting fixture including one of an accent lighting main reflector, a downlight main reflector, and a wallwasher main reflector to match a respective lighting application.

* * * * *